US010933546B2

(12) United States Patent
Lauritsen

(10) Patent No.: US 10,933,546 B2
(45) Date of Patent: Mar. 2, 2021

(54) PROGRAMMABLE HAIR TRIMMING SYSTEM

(71) Applicant: KONINKLIJKE PHILIPS N.V., Eindhoven (NL)

(72) Inventor: Klaus Lauritsen, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 18 days.

(21) Appl. No.: 15/029,290

(22) PCT Filed: Oct. 21, 2014

(86) PCT No.: PCT/IB2014/065493

§ 371 (c)(1),
(2) Date: Apr. 14, 2016

(87) PCT Pub. No.: WO2015/063651

PCT Pub. Date: May 7, 2015

(65) Prior Publication Data

US 2016/0263754 A1 Sep. 15, 2016

(30) Foreign Application Priority Data

Oct. 31, 2013 (DK) ..... 2045427

(51) Int. Cl.
*B26B 19/38* (2006.01)
*A45D 24/36* (2006.01)

(52) U.S. Cl.
CPC ..... *B26B 19/388* (2013.01); *A45D 24/36* (2013.01)

(58) Field of Classification Search
CPC ..... B26B 19/3873; B26B 19/388
USPC ..... 83/75.5
See application file for complete search history.

(56) References Cited

U.S. PATENT DOCUMENTS 2,972,351 A * 2/1961 Morgan ..... B26B 19/00 132/213
3,233,614 A * 2/1966 Lefcoski ..... B26B 19/02 132/213
3,241,562 A * 3/1966 Gronier ..... B26B 19/00 132/213
3,272,209 A * 9/1966 Kraus ..... A45D 24/36 132/213

(Continued)

FOREIGN PATENT DOCUMENTS

JP 1978085663 A 7/1978
WO 2013096572 A1 6/2013

*Primary Examiner* — Kenneth E Peterson

(57) ABSTRACT

A programmable hair trimming system has a hair trimming device including a receiving element configured to receive an electromagnetic field and at least one source element having an electromagnetic field source. The hair cutting length of the hair trimming device is adjustable, and the at least one source element is external to the hair trimming device and arranged to be placed in a fixed relationship to the head of a person. The hair trimming system is arranged to detect, by an electromagnetic tracking system, the position of the hair trimming device in relation to the at least one source element. Further the hair trimming system relates this position to a previously generated hair length profile data regarding the desired hair trimming length at various positions. Based on the desired hair trimming length at the sensed position, the trimmer cutting length is automatically and dynamically adjusted.

5 Claims, 3 Drawing Sheets

(56) References Cited

U.S. PATENT DOCUMENTS

| | | | | |
|---|---|---|---|---|
| 3,570,500 | A * | 3/1971 | Berry | B26B 19/00 132/213 |
| 3,678,944 | A * | 7/1972 | Berry | B26B 19/00 132/213.1 |
| 4,602,542 | A * | 7/1986 | Natrasevschi | B26B 19/00 132/214 |
| 5,865,192 | A | 2/1999 | Sealy | |
| 8,104,480 | B2 * | 1/2012 | Bodduluri | G06F 19/00 128/897 |
| 8,474,466 | B2 * | 7/2013 | Lakin | B26B 19/00 132/213 |
| 8,713,802 | B2 | 5/2014 | Fukutani | |
| 2011/0018985 | A1 | 1/2011 | Zhu | |
| 2012/0158019 | A1 * | 6/2012 | Tenney | A61B 19/2203 606/133 |
| 2014/0102271 | A1 * | 4/2014 | Krenik | B26B 19/3806 83/13 |
| 2014/0137714 | A1 * | 5/2014 | Krenik | B26B 19/3806 83/23 |
| 2014/0182138 | A1 * | 7/2014 | Krenik | B26B 19/3806 30/123 |
| 2014/0200734 | A1 * | 7/2014 | Krenik | G05B 15/02 700/302 |
| 2014/0261467 | A1 * | 9/2014 | Zhang | G06F 3/0482 128/898 |
| 2015/0040934 | A1 * | 2/2015 | Krenik | A45D 24/36 132/200 |
| 2015/0059187 | A1 * | 3/2015 | Krenik | B26B 19/42 30/123 |
| 2015/0197016 | A1 * | 7/2015 | Krenik | B26B 19/3806 83/13 |
| 2015/0217465 | A1 * | 8/2015 | Krenik | B26B 19/388 700/90 |
| 2015/0321365 | A1 | 11/2015 | Lauritsen | |

* cited by examiner

PROGRAMMABLE HAIR TRIMMING SYSTEM

This application is the U.S. National Phase application under 35 U.S.C. § 371 of International Application No. PCT/IB2014/065493, filed on Oct. 21, 2014, which claims the benefit of International Application No. DK2045427 filed on Oct. 31, 2013. These applications are hereby incorporated by reference herein.

FIELD OF THE INVENTION

The current invention relates to a programmable hair trimming system utilizing electromagnetic fields based position technology to relate the position of a hair trimming device to at least one reference point and to adjust the hair trimming length of the hair trimming device based on this position.

BACKGROUND OF THE INVENTION

WO2013096572A1 discusses an automated hair cutting system. The hair cutting system of WO572 teaches the use of a positioning device having multiple positioning interfaces transmitting signals, received by sensors on a hair cutting device. The hair cutting device of WO572 is described to be capable of detecting the position and orientation of the hair cutting device relative to the positioning device. According to WO572 the hair cutting device it to be placed on the head, moved over the head in a kind of combing manner in order to engage hairs, and moved away from the head. Once the hair cutting device is moved as far from the head as a predefined hair cut profile indicates the hair cutting device of WO572 is engaged and the hair cut. In other words, the WO572 device mimics a human hair dresser by obtaining a strand of hair, moving the hair trimmer at the desired cutting length and performing a hair cutting action when in that position. The WO572 device is not engaged to cut hairs in any other position than a desired cutting position.

A drawback of the device and cutting method according to WO572 is that the user has to reposition the device on the head and move the hair trimmer away from the head time and time again. This is tedious.

A further drawback of the device and cutting method according to WO572 is that the user needs agility to move the hair trimmer in a suitable manner first to engage hairs and second away from the head in order to keep the engaged, to be cut hair at the hair trimmer cutting position.

SUMMARY OF THE INVENTION

It is an object of the invention to provide a programmable hair trimming system alleviating at least some of the drawbacks of known automated hair cutting systems such as disclosed by WO572.

The object of the invention is realized by a programmable hair trimming system that has a hair trimming device which hair cutting length is adjustable, and wherein the hair trimming system is arranged to detect the position of the hair trimming device in relation to the at least one source element; relate said position to a previously generated hair length profile data regarding the desired hair trimming length at various positions; and to automatically and dynamically adjust the hair trimming length of said hair trimming device according to the detected position and the hair length profile data.

A hair trimming device according to the current invention can be moved through the hair of a person which hair is to be cut in a manner known from ordinary, non-programmable electrical clippers and trimmers. While the hair trimming device according to the present invention is moved through the hair the programmable hair trimming system according to the current invention determines the position of the hair trimming device with respect to the at least one source element. Based on this determined position the hair trimming system determines the hair cutting length associated with this position in the previously generated hair length profile. The hair trimming length of the hair trimming device is automatically and dynamically adjusted to the hair cutting length associated with the detected position in the hair length profile. The hair trimming device according to the invention can thus be moved over the head of a user while the hair trimming system is automatically and dynamically adjusting the cutting length. This a very user friendly way of creating a haircut according to a predefined style.

In an embodiment the hair trimming device is arranged to process data regarding the received electromagnetic field, such that said such data may be used to determine the position and orientation of said hair trimming device in relation to the at least one source element. By integrating this function into the hair trimming device the programmable hair trimming system may not need a separate unit for processing measurement data and calculating the required hair length according to the hair length profile.

In a further advantageous embodiment the hair trimming device is arranged to store hair length profile data, to obtain data regarding the received electromagnetic field, to calculate a hair length from said stored and received data and to control the adjustable cutting length of the hair trimming device, thereby fully eliminating a further element to the programmable hair trimming system other than the hair trimming device and the at least one source element.

The at least one source element of the programmable hair trimming system is arranged to be placed in a fixed relationship to the head of a person. This fixed relationship may create a fixed and direct relationship between the position of the hair trimming device and the at least one source element and the position on the head of the person which hair is to be cut. As the at least one source element is fixed with respect to the head of the user the at least one source element will move in unity with the head. Any movements of the head will correspond to movements of the at least one source element reflecting the movement of the head. The detected position of the hair trimming device may therefore be insensitive to movements of the head. The discussed fixed relationship will contribute to the quality of the resulting haircut.

In a preferred embodiment more than one source element is used. By increasing the number of source elements the higher the precision of the position detection and consequently the precise similarity between the previously generated hair length profile and the resulting haircut may be increased.

In an embodiment the at least one source element is arranged to be placed in a fixed relationship with an ear of a person. Such is advantageous as the ear allows for easy attachment of a source element. Further, a source element placed at or near the position of the ear is, from a position detection perspective, well placed.

In a further preferred embodiment two source elements are used, one of each placed at a different ear of the person which hair is to be cut.

In an embodiment the at least one source element is arranged to be at least partially placed inside an ear of a person. External parts of the ear, such as the pinna, can move with respect to the head while internal parts cannot. Thus by fixing the at least one source element with respect to an inner part of the ear, such as the ear canal or the external acoustic meatus the movements of the at least one source element may be in more direct relation to the movements of the head. The detected position of the hair trimming device may therefore be even more insensitive to movements of the head. The improved fixed relationship will further contribute to the quality of the resulting haircut.

In a preferred embodiment the part of the source element arranged inside the ear comprises the electromagnetic field source. As the fixed relationship between the at least one source element and the head of the person which hair is to be cut is important for the part of the source element responsible for emitting the electromagnetic field it is realized that only this part needs to be in fixed relation. It is therefore advantageous to have only this part inside the ear in order to minimize the size of the object to be placed inside the ear and to optimize user friendliness of the device.

In an embodiment the at least one source element is arranged to be placed outside an ear of a person. This allows for a bigger source element and may allow the use of less miniaturized and less expensive parts. Further this embodiment may remove objections from the person which hair is to be cut towards having elements placed inside the ears.

In an embodiment the hair trimming system is arranged to playback audio information. Such audio information may inform the user on the correct use of the hair trimming system. In alternative embodiments the hair trimming system may be arranged to playback any audio signal, e.g. MP3 files, radio or environmental sounds, in order to entertain the person whose hair is being cut. The playback of environmental sounds may be especially advantageous when at least part of the at least one source element is placed inside the ear and the at least one source element is blocking the meatus.

In an embodiment the programmable hair trimming system according to the invention comprises a base unit having an area for storing, charging and identifying the at least one source element. This is advantageous as this allows for easy storage of the at least one source element, reducing the risk of losing the at least one source element. By charging the at least one source element while it is in its storing position the chance that the at least one source element cannot operate due to a lack of electric energy in its batteries is reduced significantly. Further when two or more source elements are used it may be beneficial for the hair trimming system to identify the individual source elements. The location on the base unit during storage may make it straightforward to the user to identify the various source units. In this situation there may be a form fit between a source element and a storage position making it possible to store a given source element on one position only. It is to be appreciated that the base unit may have all three functions of storing, charging and identifying but may have one or two of these instead of all three.

In an embodiment the hair trimming device has a fixed distance between its user grip area and its distance comb. In this manner a fixed distance is maintained between the hand of the user and the head of the person which hair is being cut making the hair cutting exercise more user friendly. In this embodiment the adjustment of the cutting length takes places without changing the distance between its user grip area and its distance comb, e.g. by moving the cutting unit with respect to both the user grip area and the distance comb.

In a preferred embodiment the cutting unit and the motor driving the cutting unit are moved together in order to simplify the design of the drive train.

In an embodiment the previously generated hair length profile data regarding the desired hair trimming length at various positions comprises a list of individual position points with accompanying trimming lengths. This is an efficient way of storing a hair length profile. It will be appreciated that the number of positions and/or the position point density may change with the first derivative of the hair length: the faster the hair length profile changes the more data points are needed. The hair cutting length to which the adjustable hair trimming length is to be set may be determined by interpolation between the points defined in the hair length profile adjacent to the actual position of the hair trimming device.

With reference to the claims it is noted that the invention also relates to all possible combinations of features and/or measures defined in the various claims.

BRIEF DESCRIPTION OF THE DRAWINGS

A detailed description of the invention is provided below. The description is provided by way of a non-limiting example to be read with reference to the drawings in which.

DETAILED DESCRIPTION OF THE EMBODIMENTS

In figures showing the same embodiment or the same parts thereof, the same numbers are used for the same parts.

In the following descriptions, the term "user" describes the person holding and guiding the hair trimming device during a calibration and/or hair trimming session, and/or is operating an integrated and/or connected external computer system.

The term "treated person" describes the person on whom a hair trimming is being performed. These can be multiple persons or a single person. As the device according to the current invention is perfectly suited for creating one's own haircut, also known as do-it-yourself haircutting, the user and the treated person can be one and the same.

Figure 1:
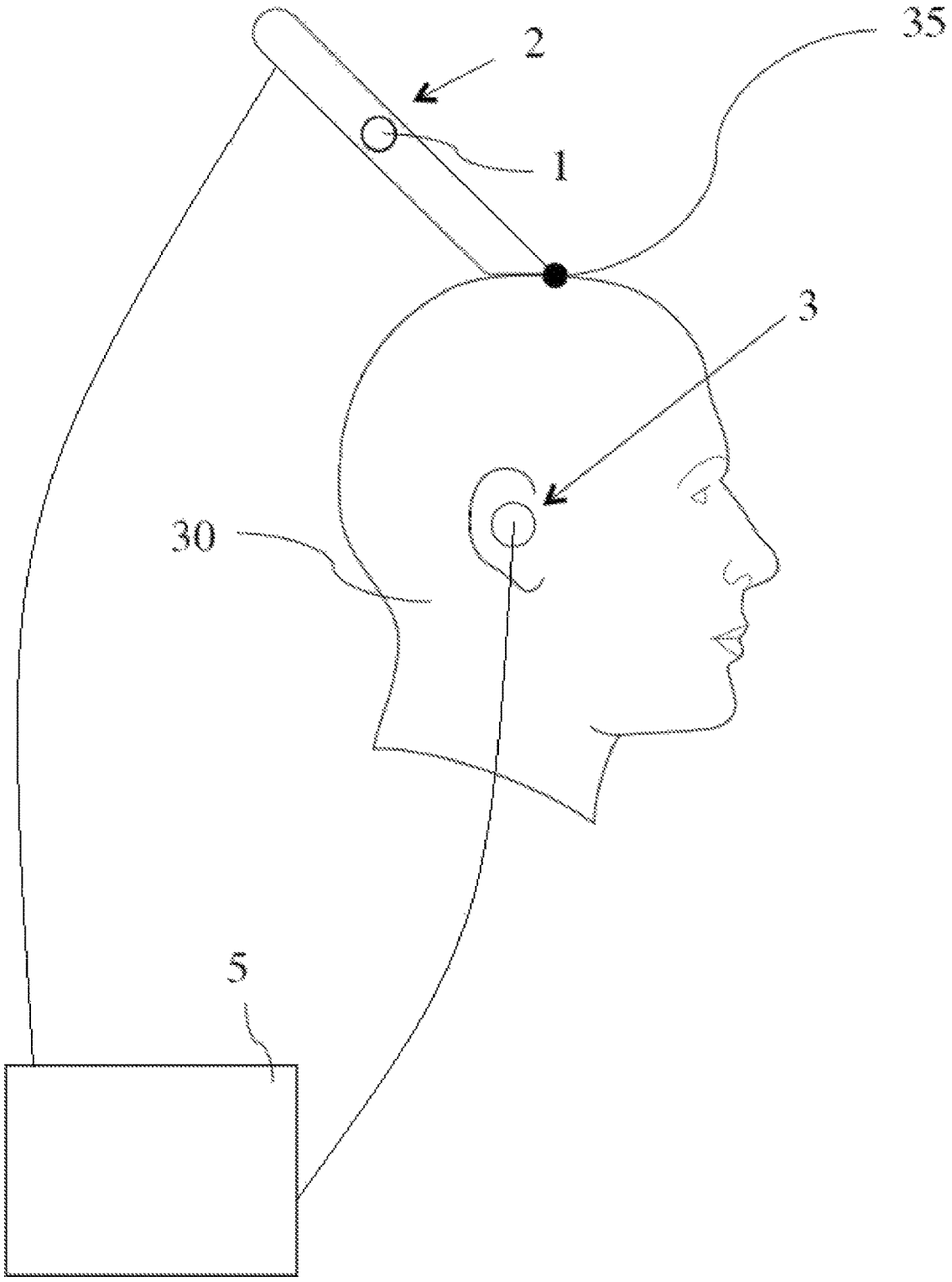
FIG. 1 illustrates schematically an overall system setup with a hair trimming device, two source elements and a base unit according to an exemplary embodiment of the current invention.

FIG. 1 illustrates an embodiment of the invention wherein the programmable hair trimming system comprises two source elements (3), one of which is visible as being attached to an ear of the head (30). The second source element (3) is attached to the other ear at the from this perspective not visible part of the head (30). In alternative embodiments, the at least one source element may be fixed to other parts of the head such as e.g. the nose, one or more eyebrows, one or more lips, the chin, the teeth and so on. A combination of these fixation options is imaginable as well. It is to be noted that the precision of the position sensing correlates with the number of source elements being used. The more source elements are used by the programmable hair trimming system to determine the position of the hair trimming device, the higher the obtainable precision of the position detection. It will be appreciated that there is an optimal number of source elements as the costs of a further source element is to be offset against the gained precision.

The trimming device (2) comprises a receiving element (1). The trimming device (2) is arranged to engage the head (30) at a touching position (35).

The position and orientation of the trimming device (2) monitored using the electromagnetic fields generated by the source elements (3) and the receiving element (1). As the source elements (3) are in fixed relationship with a point on the head (30) they will follow potential movements of the head during a hair trimming session without this movements interfering with the hair trimming procedure.

In an embodiment of the invention, source element (3) is in a shape similar to small audio headsets, and is placed inside the treated person's ear, thus preventing it from moving and turning while in use.

Parts of the source element (3) that are placed inside the treated person's ear and that touch the treated person's ear channel can optionally be interchangeable for hygienic multiple user scenarios, and for adapting to different ear shapes.

The source element (3) is powered by a battery (not shown) that can optionally be recharged while the device is placed in a base unit (5) or a hair trimming device (2).

The performance of the electromagnetic tracking system can be adapted to the desired precision by modifying the at least one source element, the receiving element and the data calculation/transmission components.

The strength, phase and orientation of the detected electromagnetic field is transmitted, wired or wirelessly, from the receiving element (1) and the at least one source element (3) to an embedded computer system.

The embedded computer system can be placed in either a base unit (5), or in the hair-trimming device (2).

The distance and orientation of the hair trimming device (2) and the at least one source element (3) with respect to each other, together with previously generated data regarding the treated person's head shape, provides sufficient data for an embedded computer system to calculate the position of the hair trimming device's (2) position in relation to the treated person's head (30), more precisely of the touching position (35).

This position information is compared by the embedded computer system to previously generated data about the desired local hair length (21) at any given point on the treated person's head (30).

Figure 2:
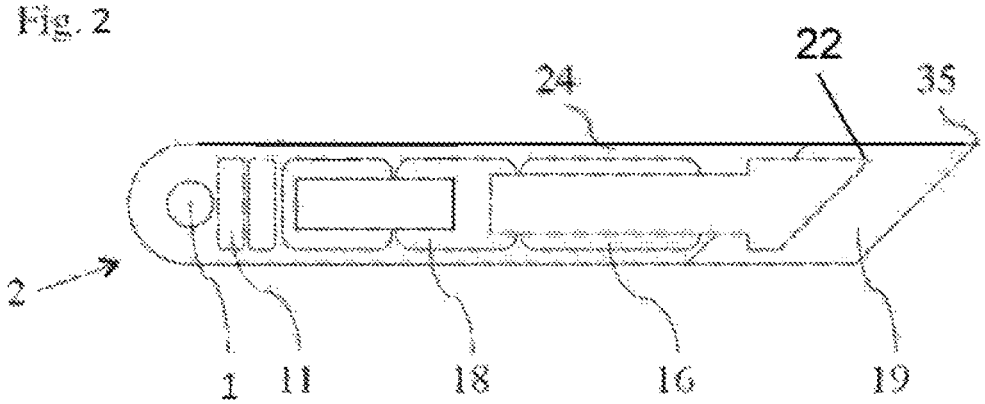
FIG. 2 illustrates schematically a hair trimming device layout with a fixed distance between a user grip area and a distance comb according to an embodiment of the invention.

The derived hair trimming length (21) is transmitted, wired or wirelessly (8), to the hair trimming device's (2) length regulation control system (11) and length regulation mechanism (18), see FIG. 2, which dynamically and automatically adjusts the hair trimming length accordingly.

Head Shape Calibration Procedure:

The hair trimming system can be adapted more precisely to the treated person's head (30) via an initial calibration procedure that generates a 3D representation of the treated person's head shape (30).

This once-per-treated person procedure may be performed by setting a hair trimming device (2) in a calibration mode with its trimmer motor (16) turned off.

The, in this embodiment, two source elements are placed in their use positions on the treated person's head, in this embodiment attached to the ears.

The hair trimming device (2) in calibration mode is placed by the user at a number of predetermined points on the treated person's head (30).

The calibration system software provides the user with a visual and/or acoustic feedback signal when a calibration point has been registered, and can also optionally show the points that the user has covered so far and the points where he still needs to position the hair trimming device (2) in calibration mode, as well as the sequence in which these points are to be touched.

In some embodiments the calibration procedure is limited to obtaining the distance between two source elements and scaling a sphere shaped approximation of the head based on the distance between the two source elements. In further alternative embodiments other approximations may be used, e.g. an ellipsoid.

Hair Length Profile (HLP):

In an embodiment of the invention, the system can present a number of default HLPs for the user to choose from.

In another embodiment of the invention, the user enters length values at a number of points on the treated person's head (30) into the HLP modification system. These values can be based on manually measured hair lengths on the treated person's head whilst having a desired hair length.

A HLP contains a set of position points (20, 26), each with an accompanying hair length between zero mm and a maximum length determined by a hair trimming device's adjustment travel length.

The number of position points (20, 26) for a HLP should be small enough to allow for a smooth HLP, while maintaining the resolution needed for hair length variation, preferably four to eight centred position points (20) and two to six pairs of symmetrical position points (26).

The number of calculated steps between the positions (20, 26) can be adjusted by the HLP modification system with due respect for seamless steps, preferably not larger than one mm.

As a HLP consists of said position points (20, 26) and accompanying position point lengths (20), the software of the embedded computer system will be calculating the local hair lengths (21), optimized for the precision of the length regulation mechanism (18) of its hair trimming device (2).

The length selectable at any position point (20, 26) is limited by the maximum travel distance of the length regulation mechanism (18) of the hair trimming device (2) to be used.

Figure 3A:
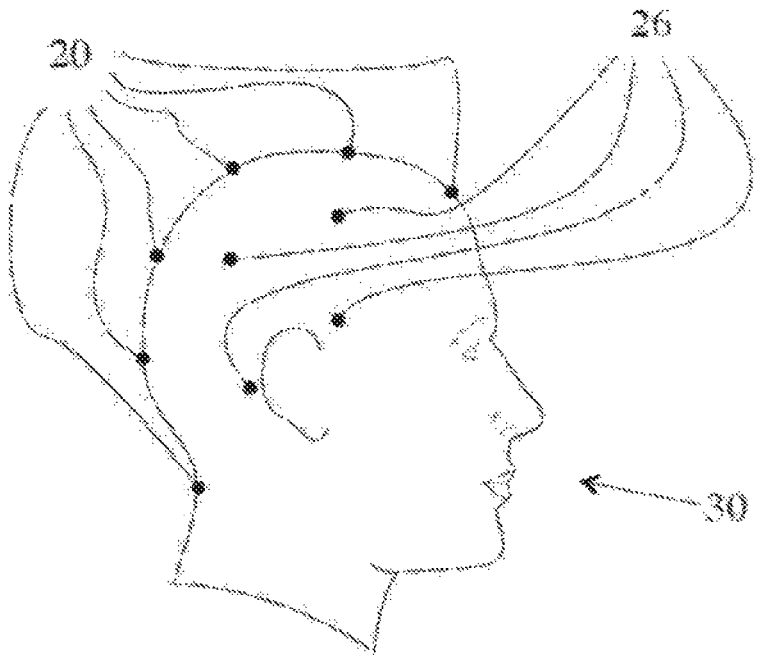
FIG. 3A illustrates schematically a placement of centred and symmetrical position points according to an embodiment of the invention.
Figure 3B:
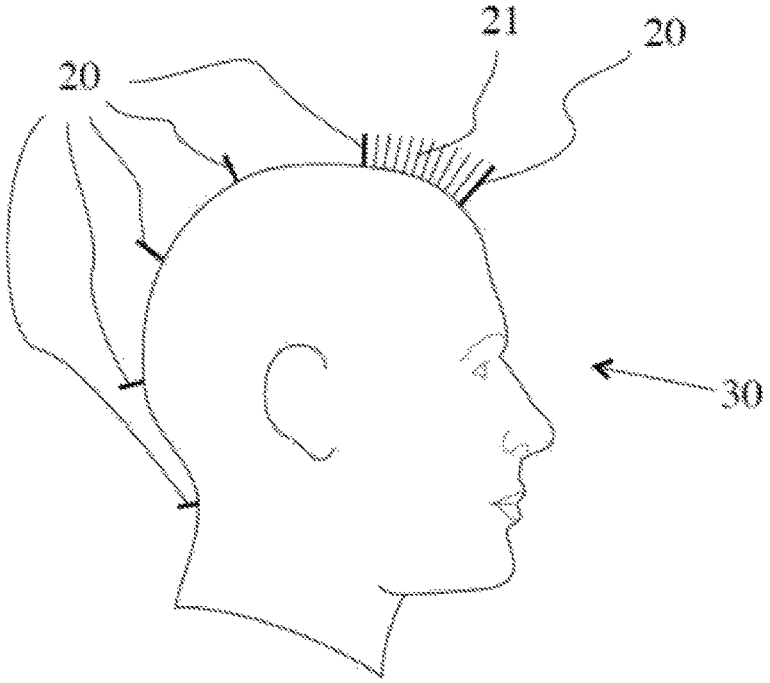
FIG. 3B illustrates schematically calculated local hair lengths between position point lengths according to an embodiment of the invention.
Figure 3C:
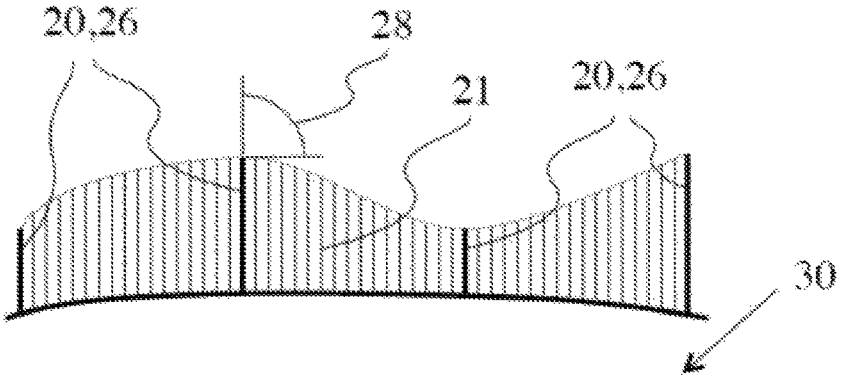
FIG. 3C illustrates schematically calculated smooth Bezier local hair lengths between position point lengths according to an embodiment of the invention.
Figure 3D:
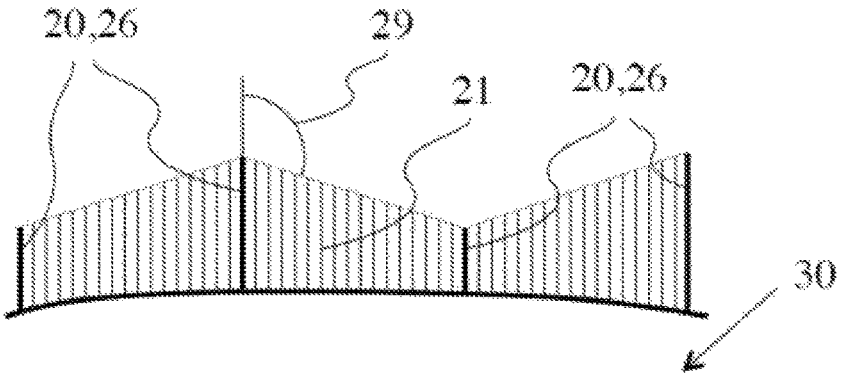
FIG. 3D illustrates schematically calculated linear local hair lengths between position point lengths according to another embodiment of the invention.

The fade shape between position lengths (20, 26) is by default set to a smooth Bezier curve (28), FIG. 3C, and can be modified by the user towards a sharper connection angle (29), FIG. 3D. In other embodiments a different fade shape algorithm may be implemented.

A number of HLPs can be stored in the hair trimming device (2) or the base unit (5).

Hair Trimming Start-Up Procedure:

Prior to a trimming session, the user selects which HLP to use and attaches the source elements (3) in their predefined attachment positions.

In order to verify the placement and orientation of the source elements (3), and to verify that the HLP selected is compatible with the current treated person (30), a start-up calibration procedure is performed by the user.

At the beginning of the start-up calibration procedure, the source elements are switched on and mounted on the treated person (30).

The hair trimming device (2) with its trimmer motor (16) switched off is placed by the user at a number of points on the treated person's head (30). The user can optionally confirm the placement by pressing a button (not shown) on the hair trimming device (2).

The user can optionally follow the calibration procedure on e.g. an interactive display of the base unit (5) or an external display linked to the base unit (5), which display shows the areas where the user so far has and still needs to position the hair trimming device (2) in calibration mode.

When sufficient points have been detected by the embedded computer system to verify the compatibility between the head of the treated person (30) and the HLP as well as the placement and orientation of the source elements (3) in relation to the treated person's head (30), the user is informed visually and/or acoustically by the embedded computer system, and the hair trimming can begin.

The trimmer motor (16) can optionally be prevented from being switched on until a start-up calibration is completed.

Hair Trimming Procedure:

The user places the hair trimming device (2) on the treated person's head (30), with contact detected by a pressure sensitive sensor in the hair trimming device (not shown). The position of the hair trimming device (2) is detected and the trimming length adjusted according to the HLP for this position. Following this initial adjustment the trimming motor (16) starts automatically.

During a hair trimming session, the user guides the hair trimming device (2) on the surface of the treated person's head (30) in the same way, as he would use a commercially available hair trimming device.

If the system includes a head-tracking device (3) with built-in audio receiver (not shown) and loudspeaker (not shown), audio information regarding the current trimming length can optionally be provided to the treated person (30), which would be desirable if he is guiding the hair trimming device (2) himself, and/or if no hair trimming visualizing system is used during the trimming session.

If, for whatever reason, the data stream from a receiving element (1) to the embedded computer system is interrupted, and/or the user moves the hair trimming device (2) too fast for the embedded computer system to calculate and transmit the current length to the hair trimming device's (2) embedded length regulation control system (11), and/or the transmission of trimming length data from the embedded computer system (4) to the hair trimming device (2) is interrupted, and/or the hair trimming device (2) is lifted from the treated person's head (30), then the trimmer motor (16) is automatically shut off, and/or the length regulation mechanism (18) is set to its maximum trimming length.

In an embodiment of the invention, FIG. 3A, the hair trimming device (2) has a fixed distance between its user grip area (24) and its comb (19), while the cutting point (22) of the hair trimming device (2), shown in FIG. 2, is moved up and down inside the distance comb (19) by the length regulation mechanism (18).

This allows the user to focus on guiding the hair trimming device (2) on the surface of the treated person's head (30) without paying attention the automatically adjusted trimming length.

While the invention has been illustrated and described in detail in the drawings and in the foregoing description, the illustrations and the description are to be considered illustrative or exemplary and not restrictive. The invention is not limited to the disclosed embodiments. It is noted that the programmable hair trimming system according to the invention and all its components can be made by applying processes and materials known per se. In the set of claims and the description the word "comprising" does not exclude other elements and the indefinite article "a" or "an" does not exclude a plurality. Any reference signs in the claims should not be construed as limiting the scope. It is further noted that all possible combinations of features as defined in the set of claims are part of the invention.

The invention claimed is:

1. A method of trimming hair using a programmable hair trimming system having a hair trimming device with a cutter, a receiving element configured to sense an electromagnetic field from at least one electromagnetic field source, and a hair length regulator to adjust a hair cutting length of the hair trimming device, the method comprising acts of:

detecting, by an electromagnetic tracking system, a position of the hair trimming device in relation to the at least one electromagnetic field source;

relating the position to a desired hair trimming length based on a previously generated hair length profile data including trimming lengths at individual position points;

determining a fade shape of the trimming lengths between the individual position points by interpolation of the trimming lengths between the individual position points, wherein the interpolated trimming lengths are determined based on a default interpolation being a Bezier curve interpolation between the individual position points;

receiving a fade shape modification of the fade shape to form a modified fade shape, wherein the interpolation of the trimming lengths between the individual position points for forming the modified fade shape is changed from the Bezier curve interpolation between the individual position points to a linear interpolation between the individual position points; and automatically and dynamically controlling the hair length regulator of the hair trimming device to adjust the hair cutting length of the hair trimming device according to the position of the hair trimming device and the interpolated trimming lengths and the modified fade shape.

2. The method of claim 1, comprising acts of:

processing field data regarding the sensed electromagnetic field;

determining the position and an orientation of the hair trimming device in relation to the at least one electromagnetic field source based on the field data.

3. The method of claim 1, wherein the at least one electromagnetic field source is configured to be placed in a fixed relationship with an ear of a person.

4. The method of claim 1, comprising acts of:

storing the hair length profile data;

obtaining field data regarding the sensed electromagnetic field;

calculating a hair length from the stored hair length profile data and the obtained field data; and controlling the hair cutting length of the hair trimming device.

5. The method of claim 1, wherein the previously generated hair length profile data includes a number of changes of hair length, and wherein the previously generated hair length profile data includes different densities of the individual position points that change as a function of the number of changes of the hair length included in the previously generated hair length profile data.

* * * * *